United States Patent [19]

Peterson et al.

[11] Patent Number: 4,824,543

[45] Date of Patent: Apr. 25, 1989

[54] ELECTRODE DESIGN FOR INCREASED CURRENT DISTRIBUTION

[75] Inventors: Richard W. Peterson; Donald C. Fisher, both of Lower Burrell; John W. Luffy, New Kensington, all of Pa.

[73] Assignee: Aluminum Company of America, Pittsburgh, Pa.

[21] Appl. No.: 127,706

[22] Filed: Dec. 2, 1987

[51] Int. Cl.[4] ..... C25C 3/16; C25C 7/00; C25C 3/12

[52] U.S. Cl. ..... 204/280; 204/288; 204/289; 204/294

[58] Field of Search ..... 204/67, 243 R, 280, 204/286–289, 297 R, 294

[56] References Cited

U.S. PATENT DOCUMENTS

| | | | |
|---|---|---|---|
| 1,036,654 | 8/1912 | Leffel | 204/286 |
| 1,679,284 | 7/1928 | Westly | 204/280 |
| 2,528,905 | 11/1950 | Ollivier et al. | 204/243 |
| 2,594,881 | 4/1952 | De Quasie et al. | 204/286 |
| 2,624,703 | 1/1953 | Park | 204/247 |
| 2,980,596 | 4/1961 | Conway | 204/243 |
| 3,280,231 | 10/1966 | Bentolila et al. | 264/29 |
| 3,398,081 | 8/1968 | Bonfils et al. | 204/286 |
| 3,707,764 | 1/1973 | Frankovich | 29/527.6 |
| 4,395,613 | 7/1983 | Barr et al. | 219/69 E |
| 4,425,200 | 1/1984 | Arita | 204/67 |
| 4,448,661 | 5/1984 | Roggen | 204/243 |
| 4,552,638 | 11/1985 | Voegel et al. | 204/286 |
| 4,557,817 | 12/1985 | Voegel et al. | 204/297 R X |
| 4,645,582 | 2/1987 | Voegel et al. | 204/286 |

FOREIGN PATENT DOCUMENTS

| | | | |
|---|---|---|---|
| 1187807 | 2/1965 | Fed. Rep. of Germany | 204/286 |
| 1937411 | 9/1971 | Fed. Rep. of Germany | 204/286 |
| 3100921 | 8/1982 | Fed. Rep. of Germany | 204/286 |
| 378524 | 6/1973 | U.S.S.R. | 204/286 |
| 537130 | 12/1976 | U.S.S.R. | 204/286 |
| 954522 | 8/1982 | U.S.S.R. | 204/286 |
| 2051864 | 1/1981 | United Kingdom | 204/67 |

*Primary Examiner*—Donald R. Valentine

*Attorney, Agent, or Firm*—Andrew Alexander; John P. Taylor

[57] ABSTRACT

An improved electrode for an electrolytic reduction cell is disclosed which comprises a nonmetallic electrode having a top surface, a central bore in the top surface, a central metal current source comprising a metal shaft or rod in the central bore, and side bores extending from the central bore toward the sides of the electrode having metallic portions therein to provide lateral current distribution from the central current source. In a preferred embodiment, the side bores are filled with metal in situ by pouring molten metal such as cast iron into the central bore to lock the central shaft in place wherein the molten metal will flow, during such filling, into the side bores to provide intimate contact with the sidewalls of side bores to provide improved lateral current distribution from the central current source across said electrode.

18 Claims, 4 Drawing Sheets

ANODE RESISTANCE FOR THREE CAST IRON DESIGNS

ANODE VOLTAGE DROPS FOR THREE CAST IRON DESIGNS

ELECTRODE DESIGN FOR INCREASED CURRENT DISTRIBUTION

BACKGROUND OF THE INVENTION

1. Field of the Invention

This invention relates to improvements in the electrodes, particularly anodes, used in the production of metal in electrolytic reduction cells. More particularly, this invention relates to improvements in the current distribution through the electrode to reduce the electrode temperature and the voltage drop therein.

2. Description of the Prior Art

In the production of metal, such as aluminum, in an electrolytic reduction cell, electrodes are used which are constructed, principally, of conductive material, such as carbon, which will conduct the high currents used for the electrolytic reduction to the molten salt bath in the cells. Carbon electrodes are normally used to avoid contamination of the bath with foreign metals and lower reduction voltage.

The current is normally carried to the electrode by large conductor busses which, in turn, are directly connected to the electrode via a metal rod which, in the case of an anode, also functions as a mechanical support for the anode as it is lowered or raised in the cell and as a cooling heat sink.

Conventionally, the electrode is attached to the metallic rod by inserting the rod into a central bore formed in the top of the electrode. An electrically conducting ram mix may then be placed into the space between the rod and the bore in the electrode. This connection, however, can be less than satisfactory both from a mechanical standpoint and electrically as well by providing a higher resistance at the interface. This problem has been partially addressed in the prior art. For example, German Patent No. 1,187,807 discloses a carbon anode having one or more cavities to receive a metal stub or rod. The surfaces of the cavities have grooves or teeth to increase the surface area which is said to provide better conductivity of the current from the rod into the anode.

German Patent No. 1,937,411 provides for a cast iron structure to be poured around a steel stub placed in the end of a carbon anode. The purpose of the cast iron structure, apparently, is to spread the current distribution across the top surface of the anode, as well as to lock the metal rod or stub to the anode by providing an undercutting in the sidewall of the recess cut into the top surface of the anode to receive the molten cast iron. The cast iron, as it solidifies, then provides a dovetail-like fit in the anode to prevent or inhibit the stub from separating from the anode.

Such arrangements do provide better mechanical bonding between the steel support rod and the anode, as well as improving the current distribution in the area immediately surrounding the metal rod or across the upper surface of the anode.

Russian Patent No. 378,524 illustrates a carbon electrode structure having the usual central bore to receive a metal stub and also having a series of holes drilled into the carbon block parallel to the central bore to receive cast iron rods. Openings are then cut into the carbon between the central bore and the cast iron rods to permit cast iron bridge pieces to be poured to connect the cast iron rods to the metal stub. The purpose of the rods is stated to be reduced power losses.

Voegel et al U.S. Pat. No. 4,552,638, assigned to the assignee of this invention, teaches the formation of an electrode for an electrolytic reduction cell which comprises a plurality of gate members extending radially from the central support shaft at the top of a non-metallic electrode with fin members extending down into the electrode from the gate members.

Voegel et al U.S. Pat. No. 4,557,817, also assigned to the assignee of this invention, also discloses the formation of an electrode for an electrolytic reduction cell comprising a plurality of gate members extending radially from the central support shaft at the top of a non-metallic electrode with fin members extending down into the electrode from the gate members. Metal conductive means, comprising a metal which will not contaminate the bath, extend downwardly in the electrode below the fin assemblies.

Voegel et al U.S. Pat. No. 4,645,582, filed as a continuation in part of the aforementioned Voegel et al '638 and '517 patents describes and claims further improvements in the disclosed gate and fin assemblies used to enhance current distribution in the electrode.

Russian Patent No. 537,130 shows a consumable current conductor for an aluminum electrolyzer prepared from aluminum powder. The conductor is shown wih downwardly sloping branches which are either formed as a whole with the rod by explosive forming or separately produced and then welded to the rod. The material used for the rod and branches is indicated to be pressed foil or sintered powder.

Despite these attempts to distribute the current more evenly in an electrode in an electrolytic reduction cell, there remains a need for a simple means for more efficiently distributing current from a central metallic current source through consumable electrode materials, such as carbon, to reduce the large lateral resistance paths which must be traversed by the current from the central metallic current source.

SUMMARY OF THE INVENTION

It has been found that the foregoing problems may be overcome, at least in part, by the in situ formation of current carrying metallic members in said electrode which generally symmetrically radiate out conically from the central, current-carrying, support shaft by providing bores in the electrode which radiate out from the central bore in the electrode which receives the support shaft. These bores are filled with cast iron as it is poured into the central bore around the central support shaft to lock it in place in the electrode.

It is therefore an object of the invention to provide an improved electrode for an electrolytic reduction cell having metallic current distribution means radiating out from the central support shaft to provide the electrode with improved current distribution characteristics.

It is another object of the invention to provide an improved electrode for an electrolytic reduction cell having metallic current distribution means conically radiating out from the central support shaft and comprising bores extending toward the sides of the electrode from the main bore which receives the central support shaft to provide the electrode with improved current distribution characteristics.

It is yet another object of the invention to provide an improved electrode for an electrolytic reduction cell having metallic current distribution means comprising bores conically radiating out from the main bore which receives the central support shaft toward the sides of the electrode and filled with metal to provide the electrode with improved current distribution characteristics.

It is a further object of the invention to provide an improved electrode for an electrolytic reduction cell having metallic current distribution means comprising bores in the electrode conically radiating out from the main bore which receives the central support shaft toward the sides of the electrode wherein the bores are filled with metal by pouring cast iron around the central support shaft in the main bore and permitting the metal to flow from the main bore into the bores conically radiating therefrom toward the sides of the electrode to provide the electrode with improved current distribution characteristics.

These and other objects of the invention will be apparent from the following description and accompanying drawings.

In accordance with the invention, an improved electrode for an electrolytic reduction cell comprises a nonmetallic electrode having a top surface, a central bore in the top surface to receive a central metal current source, and side bores extending from the central bore toward the sides of the electrode to receive metallic portions therein to provide lateral current distribution from the central current source.

DETAILED DESCRIPTION OF THE INVENTION

Figure 1:
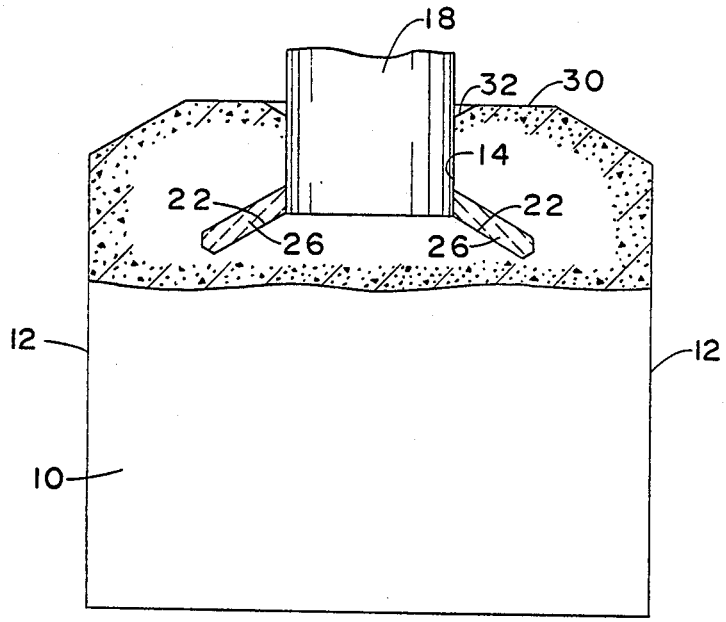
FIG. 1 is a partial side section view of one embodiment of the invention.
Figure 2:
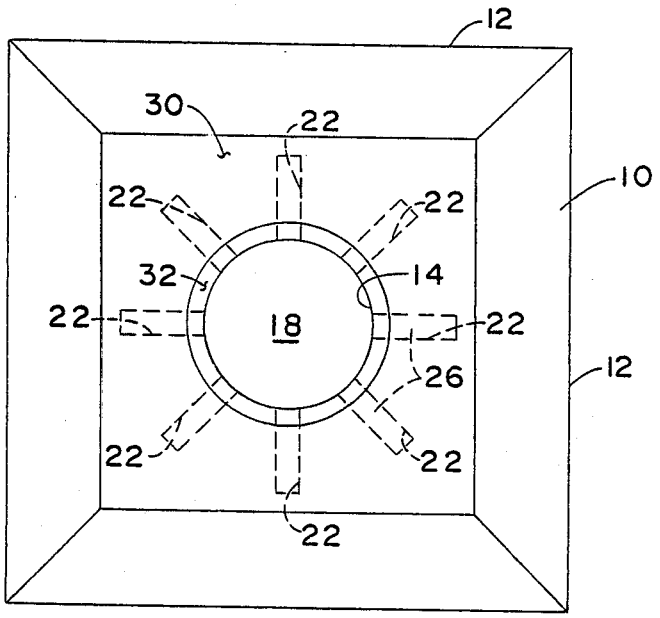
FIG. 2 is a top view of the embodiment of FIG. 1 showing, with dotted lines, the generally radial distribution of the current distributing branches.

Referring now to FIGS. 1 and 2, a nonmetallic electrode 10 is shown which may be generally square as viewed from the top, as shown in FIG. 2 and generally rectangular in vertical cross-section, as shown in FIG. 1. A central bore 14 depends downwardly from an upper surface 30 of electrode 10. A central support rod or shaft 18 provides both mechanical support for electrode 10 as well as supplying current from an external power source (not shown).

In accordance with the invention, side bores 22 extend from approximately the bottom of bore 14 toward the sidewalls 12 of electrode 10. Side bores 22, in the embodiment shown in FIG. 1, are drilled into the sidewall of bore 14 adjacent the bottom of bore 14 using only the chamfered edge 32 at the top of bore 14 and top surface 30 to provide an angle of about 30° to the horizontal. As will be discussed below, shallower bores with greater horizontal extent can also be formed in electrode 10.

The description of the location of side bores 22 as adjacent the bottom of bore 14 is intended to mean that bores 22 are formed in the sidewall of bore 14 with the bottom of each bore 22 approximately the same depth as bore 14.

As best seen in FIG. 2, bores 22 are preferably spaced symmetrically around central bore 14 to radially distribute the current horizontally throughout the horizontal cross-section of the electrode, i.e., as viewed from the top of the electrode.

In accordance with a preferred embodiment of the invention, bores 22 are filled with a metal conductor 26 by inserting central support shaft 18 into bore 14 and then pouring molten metal 26 such as cast iron into bore 14 around shaft 18. The molten metal flows into bore 14 and into bores 22 surrounding bore 14 and solidifies to form the metallic current distribution network in bores 22 in situ while locking or securing central support shaft 18 in place in bore 14.

While metal bars could be placed in bores 22 followed by filling of bore 14 with molten metal, it is preferable that bores 22 be filled with molten metal to provide complete filling and intimate contact with the sidewalls of the bores 22.

In accordance with the preferred embodiment of the invention, side bores 22 should extend horizontally a distance of at least about half the distance from the edge of the central bore 14 to the sidewall of the electrode to effectively increase the horizontal current distribution across the horizontal cross-section of the electrode. The angle of bore 22, with respect to the horizontal, may vary from about 0°—45°. Preferably, the angle will be 30° or less to provide as much horizontal component while minimizing the additional depth of bore 22 with respect to the vertical dimension of the electrode to avoid contamination as the electrode is consumed if bore 22 is filled with a metal which could contaminate the metal being reduced, e.g., cast iron filler in bores 22 when electrode 10 is used in an aluminum reduction cell.

In the illustrated embodiment shown in FIGS. 1 and 2, electrode 10 is about 18" wide, central bore 4 is 6" in diameter, and bores 22 have a diameter of about 1" and extend into electrode 10 about 4" from bore 14 at an angle of approximately 30° to the horizontal. Thus bores 22, in the illustrated embodiment, extend about 2" below the bottom of bore 14 and about 3.5" horizontally to more than double the total effective width of the metallic current distribution elements across the horizontal cross-section of the electrode.

Figure 3:
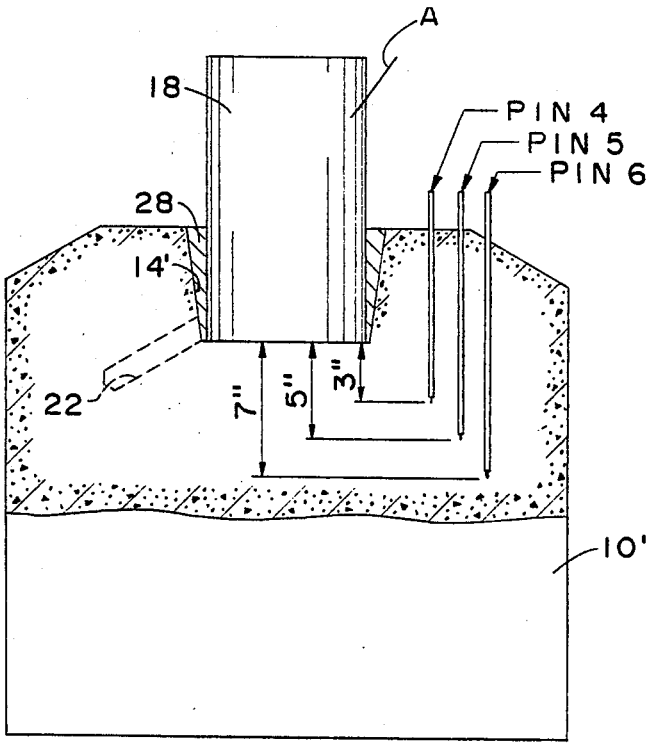
FIG. 3 is a partial side section view of an electrode generally indicating the position at which electrical readings were taken to measure the extent of the improved performance of the electrode of the invention.

In FIG. 3, an electrode similar to the embodiment shown in FIGS. 1 and 2 is illustrated with a modified central bore 14' to provide a slight taper to assist in filling bores 22 with molten metal 28 poured into bore 14' around central support shaft 18. Electrode 10' has also been further modified, for test purposes, by the provision of test pins 4–6 which have been respectively inserted 3", 5", and 7" below the bottom of bore 14' in electrode 10'. Pins 4–6 are suitably insulated on their sides with only the bottom part of each pin in contact with the carbon anode. Three such electrodes were constructed for test purposes, each having a 6" diameter central bore 14'. The first electrode, representing the control, had only central support shaft 18 mounted conventionally in bore 14'. The second test electrode was provided with a layer of Fiberfrax insulation on the bottom of bore 14'. The third electrode, constructed in accordance with the invention, was provided with bores 22 comprising 1" diameter holes drilled 4" into electrode 10′ at an angle of approximately 30° to extend about 2″ below the bottom of bore 14′. Voltage and amperage measurements were taken, via pins 4–6 and reference pin A, to illustrate the effect of the invention on the voltage and resistance of the electrodes at various depths.

Figure 4:
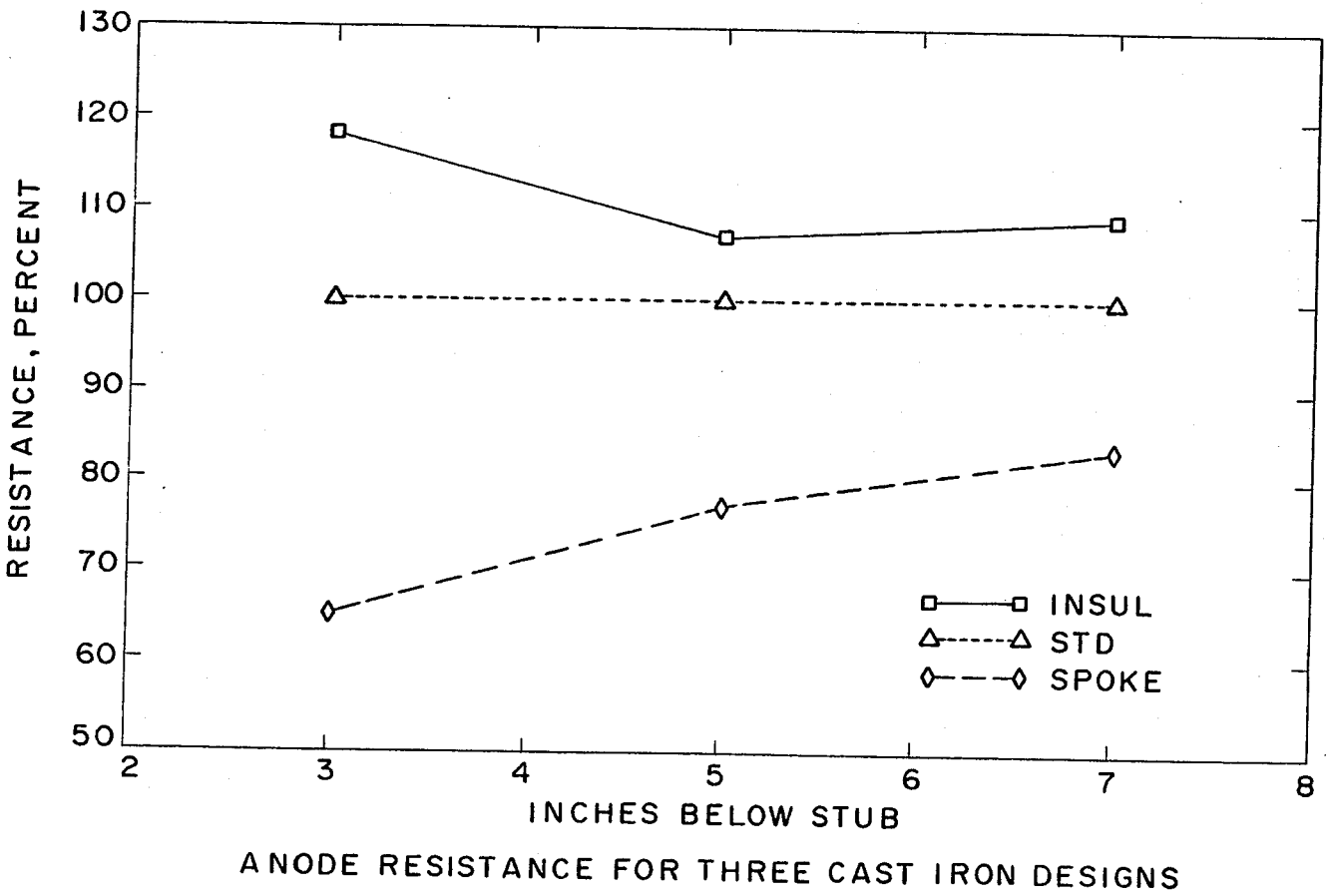
FIG. 4 is a graph showing comparative electrode resistance for prior art electrodes and the electrode of the invention.
Figure 5:
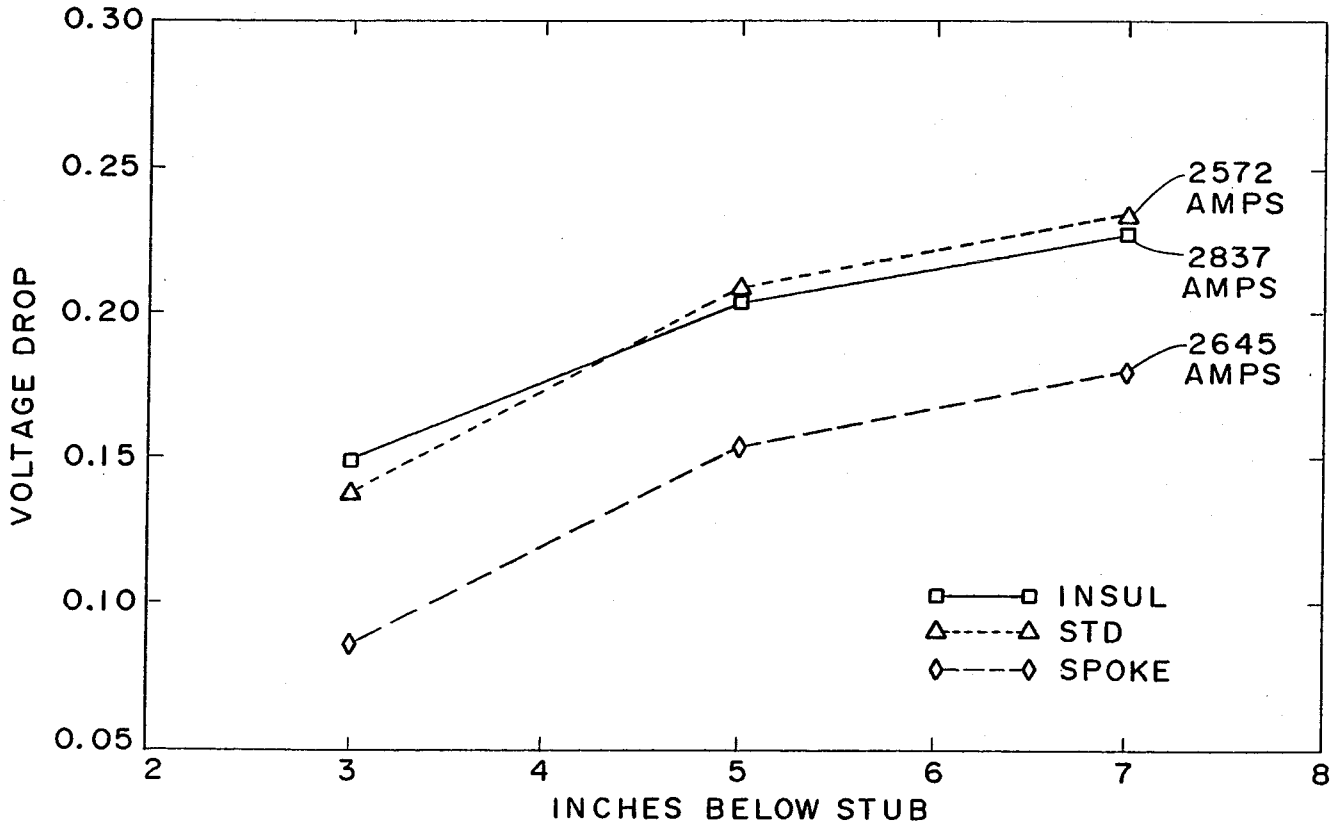
FIG. 5 is a graph showing comparative voltage drops at various levels below the surface of prior art electrodes and the electrode of the invention.

As shown in the graphs of FIGS. 4 and 5, at each depth measured, the electrode constructed in accordance with the invention showed better current distribution at all depths although the effect is most pronounced at a depth of 3″ from the bottom of bore 14′.

Figure 6:
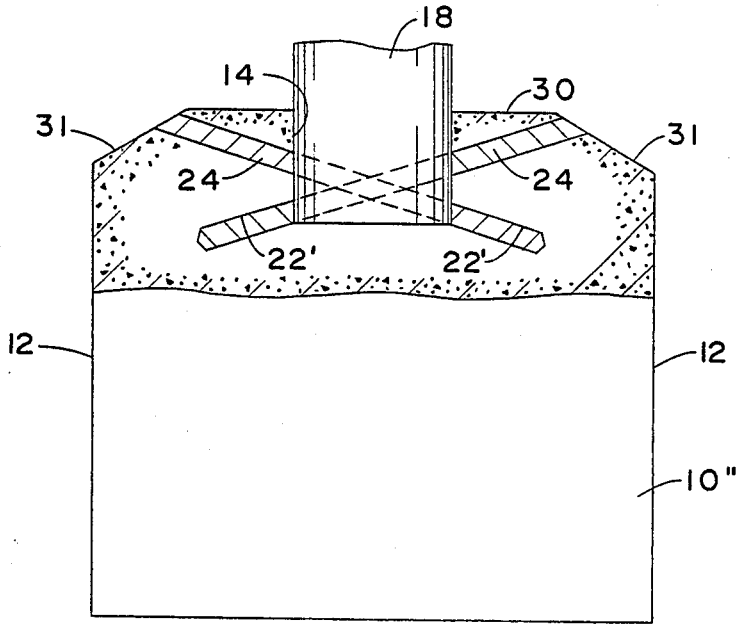
FIG. 6 is a partial side section view of another embodiment of the invention.

Turning now to FIG. 6, another embodiment is illustrated wherein bores 22′ are formed by drilling holes 24 from the top of the electrode, in the illustrated embodiment through the beveled surface 31 of the top of electrode 10″, which intersect bore 14, as shown by the dotted lines. The resultant bore 22′ has a greater horizontal component and a smaller vertical component, i.e., defines an angle with the horizontal of less than 30°. When bore 22′ is formed in this manner, the resultant hole or bore 24 may be refilled or plugged either with conductive material such as molten metal, or any other convenient filler if desired. Preferably, hole 24 is refilled with a material which is the same or similar in composition to the material comprising the original electrode, e.g., if electrode 10 comprises carbon, then a carbonaceous filler will be used.

While the beveled upper surface of the electrode, for purposes of this disclosure, will be defined as a part of the upper or top surface of the electrode, it is within the contemplation of the invention that substantially horizontal holes may be drilled into the electrode from the sidewall of the electrode to intersect bore 14 adjacent the bottom of the bore.

It should be further noted in this regard, that while the use of molten cast iron has been discussed as a convenient filler material for bores 22 and modifications thereof because of the use of this material to secure central shaft 18 in bore 14, other metals may also be used as fillers for bores 22. For example, when electrode 10 comprises a consumable carbon anode in an electrolytic reduction cell for the production of metallic aluminum, it may be advantageous to fill bores 22 with molten aluminum. If aluminum is used to fill bores 22 in such an application, subsequent consumption of the carbon anode sufficiently to expose the ends of bores 22 will not result in contamination of the aluminum being reduced, since the molten bath will not be exposed to a foreign metal when the tips of bores 22 eventually become exposed during operation of the cell.

Thus the invention provides an improved electrode for an electrolytic reduction cell wherein better horizontal current distribution in a non-metallic electrode is economically achieved through the provision of side bores which intersect the central bore in which the metal current source is received and extend the current distribution from the central bore horizontally toward the sidewalls of the electrode.

Having thus described the invention, what is claimed is:

1. An improved electrode for an electrolytic reduction cell comprising a nonmetallic electrode having a top surface, a central bore in the top surface to receive a central metal current source, and a plurality of side bores extending from the sidewall of said central bore substantially adjacent the bottom of said central bore toward the sides of the electrode at an angle, with respect to the horizontal, of from 0° to not greater than 45° to receive metallic portions therein to provide lateral current distribution from said central current source.

2. The improved electrode of claim 1 wherein said plurality of side bores are symmetrically spaced around said central bore to evenly distribute the current from said central metal current source horizontally along said electrode.

3. The improved electrode of claim 1 wherein said side bores subtend an angle with respect to the horizontal of not greater than 30°.

4. The improved electrode of claim 2 wherein said side bores are filled with metal portions which are in electrical contact with the metal in said central bore.

5. The improved electrode of claim 4 wherein said side bores are filled with a metal which was paused into said bores in molten form and allowed to solidify in said side bores to completely fill said bores and provide intimate contact with the nonmetallic sidewalls of said bores comprising said electrode.

6. The improved electrode of claim 5 wherein said metal in said side bores comprises solidified cast iron initially introduced into said central bore around said central metal current source and allowed to flow from said central bore into said side bores whereupon subsequent solidification of said metal serves to mechanically secure said central metal current source in said central bore and also provides an integrated metallic current distribution from said central metal current source to the portions of said electrode forming the sidewalls of said side bores.

7. The improved electrode of claim 5 wherein said side bores are filled with aluminum initially poured into said bores and allowed to solidify in intimate contact with said electrode sidewalls of said side bores.

8. An improved electrode for an electrolytic reduction cell comprising a nonmetallic electrode having a top surface, a central bore in said top surface containing a central metal current source, and side bores defining an angle of from 0°–45° to the horizontal extending substantially from the bottom of the central bore toward the sides of the electrode containing metallic portions formed therein in intimate contact with the side walls of said bores by initially filling said central bore and side bores with molten metal to provide lateral current distribution from said central current source across said electrode.

9. An improved method of forming an improved electrode for an electrolytic reduction cell comprising a nonmetallic electrode having a top surface and a central bore in said top surface containing a central metal current source, the improved method comprising:

(a) forming side bores in said electrode from said central bore defining an angle of from 0°–45° to the horizontal and extending substantially from the bottom of said central bore toward the sides of the electrode; and (b) filling said central bore and said side bores with molten metal to provide intimate contact with the side walls of said bores and with said central metal current source;

whereby improved lateral current distribution from said central current source is provided across said electrode.

10. An improved electrode for an electrolytic reduction cell comprising a nonmetallic electrode having a top surface, a central bore in the top surface to receive a central metal current source, and a plurality of side bores extending from the sidewall of said central bore substantially adjacent the bottom of said central bore toward the sides of the electrode at an angle, with respect to the horizontal, of from 0° to not greater than 45° to receive metallic portions therein, said plurality of side bores being symmetrically spaced around said central bore to evenly distribute the current from said central metal current source horizontally along said electrode, said side bores located in said electrode at an angle, with respect to the horizontal, which permits formation of said side bores by angle drilling into said electrode from said central bore adjacent the bottom of the sidewall thereof.

11. An improved electrode for an electrolytic reduction cell comprising a nonmetallic electrode having a top surface, a central bore in the top surface to receive a central metal current source, and a plurality of side bores extending from the sidewall of said central bore substantially adjacent the bottom of said central bore toward the sides of the electrode at an angle, with respect to the horizontal, of from 0° to not greater than 45° to receive metallic portions therein, said plurality of side bores being symmetrically spaced around said central bore to evenly distribute the current from said central metal current source horizontally along said electrode, said side bores formed by drilling into said electrode from the outer surface of said electrode at an angle which will permit said bore to intersect at least one sidewall of said central bore adjacent the bottom of said central bore.

12. The improved electrode of claim 11 wherein said side bores are formed by angle drilling into said electrode from a point on the top surface of said electrode spaced from said central bore to intersect the sidewall of said central bore adjacent said bottom of said bore on the opposite side of said central bore from the point of entry of said drilling on the top surface of said electrode.

13. The electrode of claim 12 wherein the upper portion of said hole drilled into said electrode from the top surface of said electrode and extending to the first intersection with said central bore is refilled with a material substantially similar to the material comprising said nonmetallic electrode.

14. An improved method of forming an improved electrode for an electrolytic reduction cell comprising a nonmetallic electrode having a top surface and a central bore in said top surface containing a central metal current source, the improved method comprising:

(a) forming side bores in said electrode by drilling into said electrode through said central bore to form side bores defining an angle of from 0°–45° to the horizontal which extend substantially from the bottom of said central bore toward the sides of the electrode; and (b) filling said central bore and said side bores with molten metal to provide intimate contact with the side walls of said bores and with said central metal current source;

whereby improved lateral current distribution from said central current source is provided across said electrode.

15. The method of claim 14 wherein said step of filling said central bore and said side bores with molten metal comprises filling said bores with molten cast iron.

16. The method of claim 14 wherein said step of filling said side bores with molten metal comprises filling said side bores with molten aluminum.

17. An improved method of forming an improved electrode for an electrolytic reduction cell comprising a nonmetallic electrode having a top surface and a central bore in said top surface containing a central metal current source, the improved method comprising:

(a) forming side bores in said electrode by drilling into said electrode through the top surface of said electrode to intersect at least one side of said central bore adjacent the bottom of said central bore to form side bores defining an angle of from 0°–45° to the horizontal which extend substantially from the bottom of said central bore toward the sides of the electrode; and (b) filling said central bore and said side bores with molten metal to provide intimate contact with the side walls of said bores and with said central metal current source;

whereby improved lateral current distribution from said central current source is provided across said electrode.

18. The method of claim 17 including the further step of filling the upper portion of the openings drilled into said electrode down to the intersection of said central bore with a material substantially similar to the material comprising said nonmetallic electrode.

* * * * *